US005556195A

United States Patent [19]

Glebe

[11] Patent Number: 5,556,195

[45] Date of Patent: Sep. 17, 1996

[54] MOTORIZED ELECTRICAL APPARATUS FOR MOVEMENT OF AN ELECTRICAL FIXTURE WITH UNINTERRUPTED ELECTRICITY

[75] Inventor: Harlan Glebe, Blue Bell, Pa.

[73] Assignee: Suhar Corporation, Blue Bell, Pa.

[21] Appl. No.: 385,014

[22] Filed: Feb. 7, 1995

[51] Int. Cl.[6] ..... F21V 21/16

[52] U.S. Cl. ..... 362/386; 362/407; 362/418; 248/328

[58] Field of Search ..... 362/404, 407, 362/418, 386; 248/327–329; 254/343

[56] References Cited

U.S. PATENT DOCUMENTS

| | | | |
|---|---|---|---|
| 2,609,170 | 9/1952 | Farrington et al. | 362/386 |
| 3,610,584 | 10/1971 | Pfaff, Jr. | 254/173 |
| 4,316,238 | 2/1982 | Booty et al. | 362/147 |
| 5,105,349 | 4/1992 | Falls et al. | 362/405 |
| 5,420,772 | 5/1995 | Evans | 362/386 |

FOREIGN PATENT DOCUMENTS

| | | | |
|---|---|---|---|
| 2418414 | 10/1979 | France | 248/327 |
| 54-127164 | 10/1979 | Japan | 362/404 |
| 5-28816 | 2/1993 | Japan | 362/404 |

*Primary Examiner*—Denise L. Gromada
*Assistant Examiner*—Sara Sachie Raab
*Attorney, Agent, or Firm*—Panitch Schwarze Jacobs & Nadel, P.C.

[57] ABSTRACT

A motorized electrical apparatus for movement of an electrical fixture with uninterrupted electricity provided to the fixture. The apparatus includes a powered winch assembly for vertical movement of the fixture between a first, in-use position and a second, service position. The winch assembly has a moveable winch cable having a first end, which is anchored to the winch, and a second end, which engages the fixture. A retractable cable reel assembly having an electric cable for providing electricity to the fixture is also provided. The electric cable has a first end, which is electrically connected to an electric power supply, and a second end, which is electrically connected to the fixture. The apparatus also includes a pulley support assembly for mounting a pulley in a position above the fixture to guide the winch cable and the electric cable as the fixture is moved between the first and second positions so that the fixture remains generally centered below its mounting position. A control switch activates the winch assembly to move the fixture between the first and second positions. As the winch cable is unreeled, the fixture is lowered from the first position to the second position and the electric cable is unreeled from the retractable cable reel assembly by the movement of the fixture.

16 Claims, 4 Drawing Sheets

MOTORIZED ELECTRICAL APPARATUS FOR MOVEMENT OF AN ELECTRICAL FIXTURE WITH UNINTERRUPTED ELECTRICITY

FIELD OF THE INVENTION

The present invention relates generally to motorized electrical assemblies for movement of electrical fixtures. More particularly, the present invention provides a motorized winch assembly for movement of a lighting fixture between a first, in use position and a second, service position with uninterrupted electricity provided to the light fixture, thereby allowing the light fixture to be cleaned or serviced in the second service position.

BACKGROUND OF THE INVENTION

Cleaning and maintenance of out of reach lighting fixtures is often a problem for homeowners and maintenance personnel. With the increasing popularity of cathedral ceilings and raised entrance ways, ceiling lighting fixtures are commonly being mounted 10 to 15 feet above floor level, requiring the use of a ladder in order to perform routine cleaning and maintenance.

It has been recognized that a device for raising and lowering a lighting fixture for servicing, such as cleaning or replacement of light bulbs, overcomes the safety problems associated with utilizing a ladder to reach an elevated fixture. Several systems for raising and lowering lighting fixtures to permit service and cleaning have been proposed. One known system utilizes a lowering mechanism for a light fixture having a drive motor and a braking mechanism. This systems provides a flexible stainless steel ribbon which is unwound from a drum to lower a light fixture. This system requires the use of a specific ceiling mounting plate having two exposed contacts, and a canopy at the top of the light fixture having matching electrical contacts to provide electricity to the light fixture when the lighting fixture is in the fully raised position. When the fixture is lowered from its uppermost, in use position, power to the fixture is interrupted. Because power to the fixture is interrupted as soon as it is lowered, it is not possible to check which light bulbs are burned out when the fixture is in the lowered, service position. Additionally, the contacts at the fixed ceiling mounting plate can become corroded, requiring the user to use a ladder or other means of access to the fixed ceiling mounting plate to clean the contacts.

In another known system, the lighting fixture is raised and lowered by a hoist mechanism utilizing a gear motor. A ceiling mounted junction box includes a first set of contacts for supplying electricity to the light fixture, and the canopy junction box, attached to the light fixture, includes a second set of contacts for receiving electricity. When the light fixture is lowered from the ceiling, no electricity is provided to the light fixture. Additionally, the use of fixed, ceiling mounted contacts which can become corroded still may require someone to climb a ladder to clean the contacts.

Another known system utilizes a mechanically operated carriage which is moved in a reciprocal, sliding motion between first and second positions to raise and lower a light fixture. The light fixture is supported by a flexible conductor which has one end connected to the fixture and an intermediate portion extending around part of the carriage. Movement of the carriage displaces the intermediate portion of the flexible conductor to raise or lower the fixture. This system only allows for limited vertical movement of a light fixture based on the available horizontal movement of the carriage. Additionally, this system can only be utilized for light weight light fixtures because the light fixture is supported by the flexible conductor. Repeated use with an overweight fixture can result in damage to the conductor.

The present invention resulted from the inventor's observation of the problems with the prior art systems and his successful efforts to solve them. The present invention, therefore, is directed toward a system for raising and lowering light fixtures which provides electricity to the light fixture when it is in the lowered, service position.

SUMMARY OF THE INVENTION

Briefly stated, the present invention comprises a motorized electrical apparatus for movement of an electrical fixture with uninterrupted electricity provided to the fixture. The apparatus includes a powered winch assembly for vertical movement of the fixture between a first, in-use position and a second, service position. The winch assembly includes a moveable winch cable having a first end, which is anchored to the winch, and a second end, which engages the fixture. The apparatus further includes a retractable cable reel assembly having an electric cable for providing electricity to the fixture. The electric cable has a first end, which is electrically connected to an electric power supply, and a second end, which is electrically connected to the fixture. A pulley support assembly is provided for mounting a pulley in a position above the fixture. The pulley guides the winch cable and the electric cable as the fixture is moved between the first and second positions to maintain the fixture generally centered below its mounting position. A control switch is provided for activating the winch assembly to move the fixture between the first and second positions such that as the winch cable is unreeled, the fixture is lowered from the first position to the second position. The electrical cable is unreeled from the retractable cable reel assembly by the movement of the fixture.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In 10 the drawings.

DETAILED DESCRIPTION OF PREFERRED EMBODIMENTS

Figure 1:
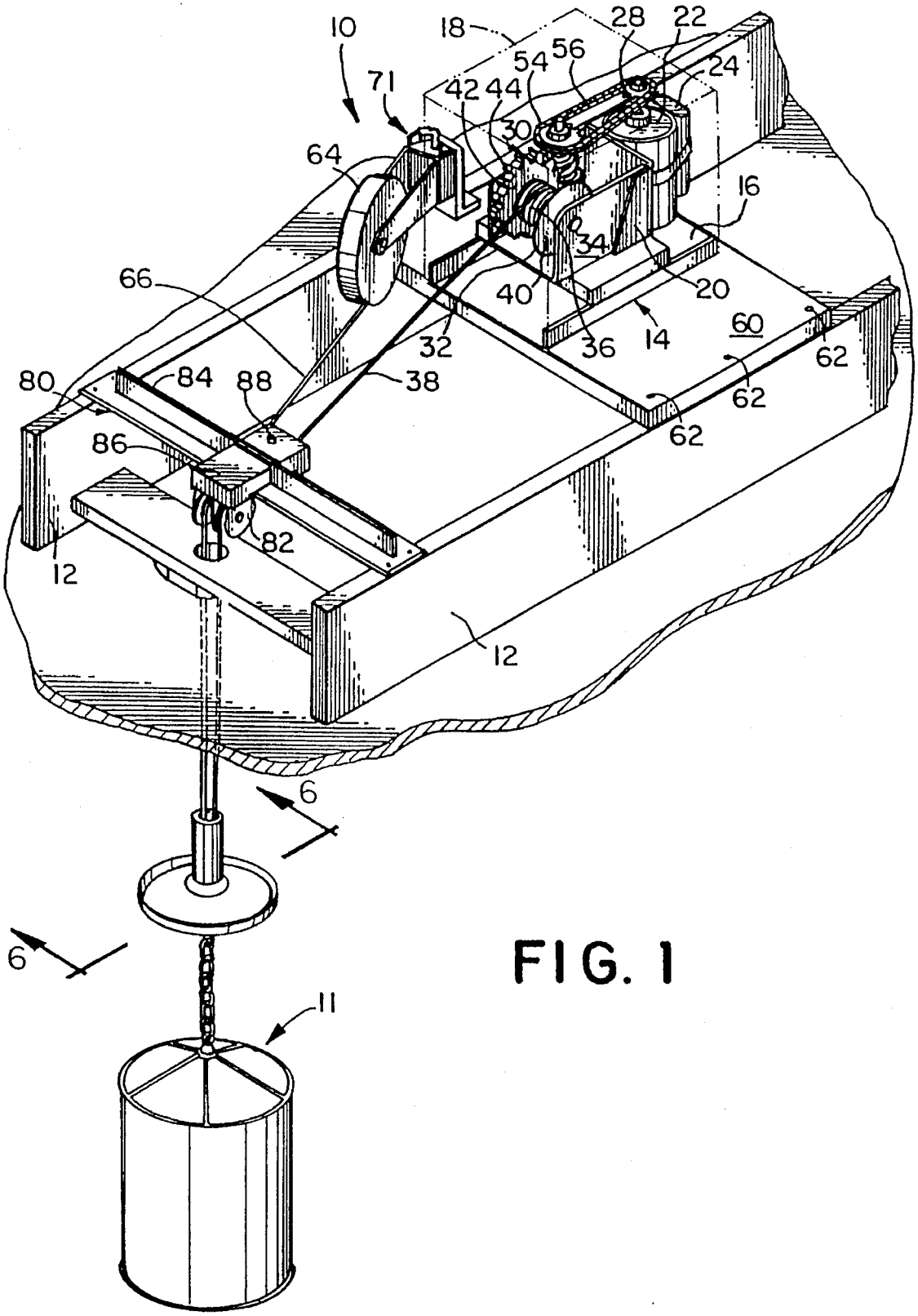
FIG. 1 is a perspective view of a motorized electrical apparatus for movement of an electrical fixture with uninterrupted electricity in accordance with a preferred embodiment of the present invention.
Figure 2:
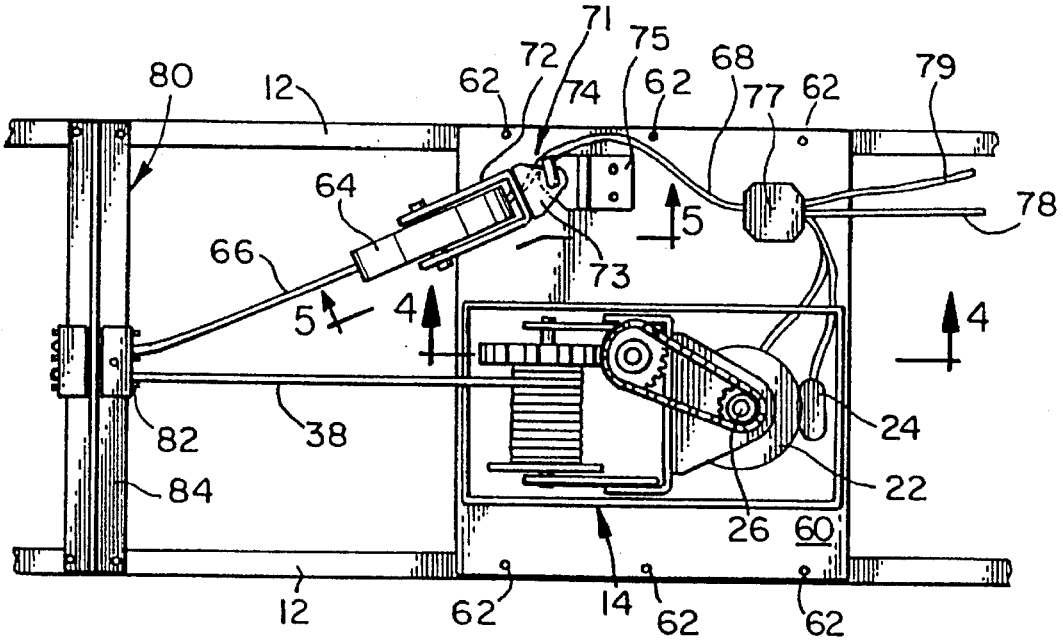
FIG. 2 is a top plan view of the motorized electrical apparatus of FIG. 1.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the motorized electrical apparatus for movement of an electrical fixture and designated parts thereof. The terminology includes the words above specifically mentioned, derivatives thereof and words of similar import.

Referring to the drawings, wherein like numerals indicate like elements throughout, there is shown in FIGS. 1 through 8 a preferred embodiment of a motorized electrical apparatus 10 for movement of an electrical fixture 11 with uninterrupted electricity provided to the fixture 11 in accordance with the present invention. FIG. 1 is a perspective view of the motorized electrical apparatus 10 for movement of electrical fixture 10, hereinafter referred to as the "movement apparatus" 10, as installed in a preferred manner on typical or standard ceiling joists 12.

Referring to FIGS. 1–5, the movement apparatus 10 includes a powered winch assembly 14 for vertical movement of the fixture 11 between a first, in-use position and a second, service position. The in-use position is generally with the fixture 11 in an elevated position, 10 to 15 feet above the floor, and the service position is generally 2 to 3 feet from the floor where the fixture 11 can be easily accessed.

The winch assembly 14 includes a base 16 and a cover 18 (shown in phantom in FIG. 1) which protects the moving components of the winch assembly 14. The base has a flange around its periphery which is sized to fit inside the cover 18 when the cover is installed. The cover 18 is held in position by fasteners (not shown) inserted through apertures along the bottom edge of the cover and aligned apertures in the flange. Preferably, the base 16 and the cover 18 are formed from aluminum sheet, and the cover 18 is approximately 16 inches long by 8½ inches high by 7 inches wide. The cover height is less than the height of a standard ceiling joist. However, it is understood by those skilled in the art that the base 16 and cover 18 could be made from other materials such as steel, plastic or sheet metal. Additionally, the profile of the cover 18 can be varied in form, if desired, to suit particular applications. Finally, the cover 18 may be held in place by an interference fit, clips or any other suitable device known to those skilled in the art.

Attached to the base 16 is a support bracket 20, having a generally perpendicular channel portion 21, which supports the components of the powered winch assembly 14. The support bracket 20 is a welded assembly made from sheet metal. However, it is understood by those skilled in the art that the support bracket 20 can be made of other material, such as machined or cast aluminum, steel or the like. Moreover, the shape of the bracket 20 can be varied to suit the components being utilized in a particular application.

A motor 22, having an attached capacitor 24, is mounted to the channel portion 21 of the support bracket 20. The motor 22 is mounted in such a manner that the output drive shaft 26 is normal to and extends in a perpendicular direction from the base 16. A first gear 28 is mounted to the drive shaft 26 of the motor 22. The preferred motor is a ⅛ horsepower AC motor which is available as part number KPL421BOT from Robbins & Myers and the first gear 28 is nominally 1.0 inches in diameter. However, those of skill in the art will recognize that the motor type and horsepower rating, as well as the motor mounting position can be varied, as desired, depending on the particular application.

A winch 30 including a cable reel 32, mounted for rotation in a U-shaped frame 34, is attached to the support bracket 20. The winch cable reel 32 includes a cylindrical center portion 36 for spooling the winch cable 38 and two disc shaped ends 40, 42. The second disc shaped end 42 is provided with gear teeth 44.

Figure 4:
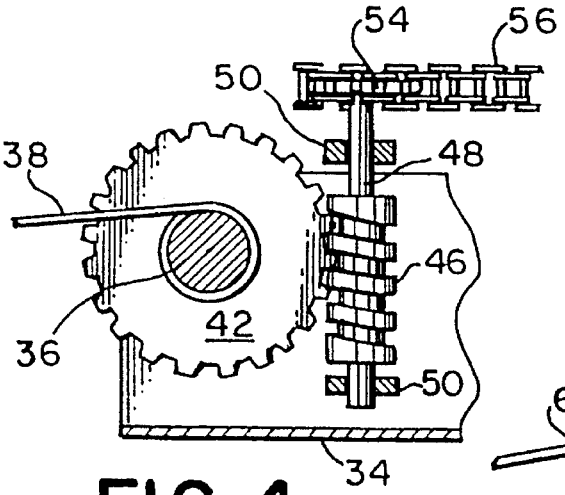
FIG. 4 is an enlarged partial cross-sectional view of the motorized electrical apparatus taken along lines 4—4 of FIG. 2.

Referring to FIGS. 1 and 4, a worm gear 46, mounted on shaft 48, engages the gear teeth 44 of the cable reel 32. The worm gear 46 drivingly meshes with gear teeth 44 on the winch cable reel 32 such that the mesh is nonreversible. That is, the worm gear 46 can drive the cable reel 32; however, because of the slope of the tooth surface of the worm gear 46 and the transverse direction of movement, applying a force to the cable reel 32 does not turn the worm gear 46 and its associated shaft 48. The drive ratio between the worm gear 46 and the cable reel 32 in the present embodiment is 40:1; however, the drive ratio may be varied to suit a particular application. The shaft 48 is rotatably mounted in a bracket 50. The bracket 50 is affixed to the frame 34. In the preferred embodiment, bushings (not shown) are pressed into the bracket 50 to allow the shaft 48 to turn smoothly. However, it is understood that various winches can be utilized with the present invention, if desired, depending on the particular application. The type of winch selected depends to some degree on the size of the fixture and the distance that it is being moved.

A second gear 54 is mounted to the end of the shaft 48. The second gear is nominally 2.0 inches in diameter. The first and second gears 28, 54 are drivingly connected by a drive member, in the present embodiment a chain 56. In the preferred embodiment, the gear train provided by the motor gear 28, gear 54, worm gear 46, and the gear teeth 44 on the cable reel 32 provide an 80:1 reduction ratio. However, it is understood by those skilled in the art that the drive reduction ratio can be varied by changing the sizes of the first and/or second gears 28, 54 to achieve a desired power and lift speed depending on the motor speed and the size of the cable reel 32. Additionally, other drive systems such as pulleys and belts or direct drive gears can be used.

The winch assembly 14 further includes a movable winch cable 38 having a first end which is anchored to the cable reel 32 of the winch 14, and a second end 39, which engages the fixture 11. The winch cable 38 is wound around the winch cable reel 32 and extends outwardly from the winch assembly 14. Preferably, the cable is made of stranded steel and is long enough to permit the fixture 11 to be lowered to the desired service height. However, it is understood by those skilled in the art that the winch cable 38 can be made of other materials, such as a synthetic monofilament or braided multi-filament material. Moreover, the length of the cable 38 and the capacity of the cable reel 32 can be varied to suit particular applications.

The winch assembly 14 is preferably mounted to a platform 60. The platform 60 is attached by fasteners 62 to adjacent ceiling joists 12 above the fixture location. In the preferred embodiment, the platform is made of plywood, and is approximately 16 inches long by 18 inches wide.

Although ceiling joists are typically 16 inches on center, additional width is provided in case the joists are mislocated. The fasteners 62 are preferably wood screws, but other fasteners nails, lag bolts, clips or the like may be employed. However, it is understood by those skilled in the art, that other materials are suitable for the platform 60 such as wood or particle board, or the platform can be replaced by formed sheet metal or a plurality of aluminum rails. Moreover, it is similarly understood that the dimensions of the platform 60 can be varied, if desired, to suit particular applications. Particularly, where the motorized apparatus 10 is to be installed in the space between joists 12, the width of the platform 60 is reduced to 14 inches or less so that it can be positioned between the joists 12, and angle brackets (not shown) or other similar fasteners are provided to attach the platform 60 to the sides of the joists 12 (not shown).

A retractable cable reel assembly 64 having an electric cable 66 for providing electricity to the fixture 11 is attached to the platform 60. In the preferred embodiment, the retractable cable reel assembly 64 is made from part number 1A136 manufactured by Alert Co. of Bedforde Heights, Ohio. This commercially available part has been slightly modified to remove the clutch, which disengages the retracting spring from the reel, so that there is a constant tension on the electric cable 66. After the clutch is removed, the spring is rewound. The ball stop on the electric cable 66, the receptacle and plug provided are also removed. However, it is understood by those skilled in the art, that other cable reels are suitable for the present invention and the shape and dimensions of the cable reel 64 can be varied to suit particular applications.

Figure 5:
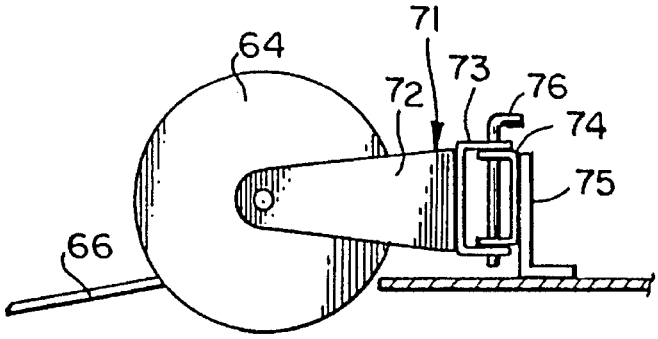
FIG. 5 is an enlarged partial cross-sectional view taken along line 5—5 in FIG. 2.

The retractable cable reel assembly 64 is pivotally mounted by a bracket assembly 71 to the platform 60. Referring to FIGS. 1 and 5, the bracket assembly 71 is comprised of a U-shaped cable reel holder 72 which is attached to a first channel bracket 73. The first channel bracket 73 has two triangular shaped horizontal flanges. A second channel bracket 74, having triangular top and bottom flanges, is attached to an angle bracket 75 mounted to the platform 60. A pin 76 is installed through aligned apertures in the flanges of the channel brackets 73, 74 to provide a pivoting connection. It will be understood by those skilled in the art that other means for providing a pivotal mount for the retractable cable reel assembly 64 may be utilized with the present invention, such as a hinge.

Preferably, the winch assembly 14 and the retractable cable reel assembly 64 are mounted together as a unitary structure on the platform 60. However, it is also understood by those skilled in the art that the retractable cable reel assembly 64 can be mounted in another position with the bracket assembly 71, such as directly to a ceiling joist 12 or to a roof beam (not shown). Moreover, depending on the location and orientation of the retractable reel assembly 64 relative to the fixture position, a pivotal mounting system may not be required. The specific arrangement may be varied to suit particular applications.

Figure 6:
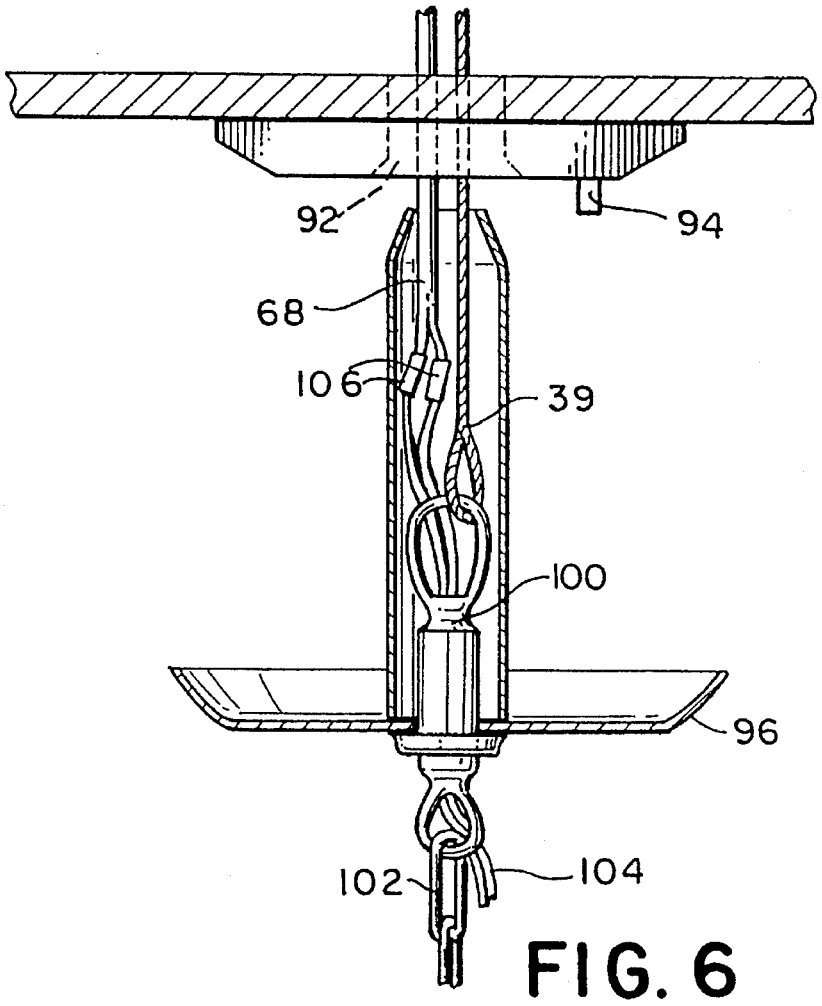
FIG. 6 is an enlarged partial cross-sectional view taken along line 6—6 in FIG. 1.

A junction box 77 is also mounted to the platform 60. The junction box 77 houses the connection for the electric power supply lines 78, 79 and the retractable cable reel assembly 64 and the winch motor 22. The electric cable 66 has a first end 68, which is electrically connected to an electric power supply 78 in the junction box 77. The electric cable 66 has a second end 70, which is electrically connected to the fixture 11, as shown in FIG. 6. Preferably, the power supply 78 is controlled by a fixture switch (not shown). The second power line 79 supplies power to the motor 22 and capacitor 24 and is controlled by a switch in a manner hereinafter described.

Referring again to FIGS. 1–3, a pulley support assembly 80 for mounting a pulley 82 in a position generally above the fixture 11 is provided. The pulley support assembly 80 includes a beam 84 which is affixed to the tops of two adjacent floor joist. A C-shaped slider 86 is slidably disposed on the beam 84. The pulley 82, which is preferably a double sheave pulley, is affixed to the C-shaped slider 86. A threaded locking element 88 is threaded through an aperture in the slider 86 to lock the slider 86 in the desired position between the joists 12. Preferably slider 86 is located so that the pulley 82 is aligned directly above the fixture 11 for guiding the winch cable 38 and the electrical cable 66 as the fixture is moved between the first and second positions to ensure that the fixture remains generally centered below its mounting position. In the preferred embodiment, the beam 84 is a hot rolled steel tee having a 2 inch wide base and a 1 inch vertical flange. The tee is preferably 0.125 inches thick and 18 inches long. The extra length allows the beam 84 to be installed even if the ceiling joists 12 are mislocated. The slider 86 is made from a extruded aluminum and has a slot which provides a sliding fit with the beam 84. The slider 86 has a wall thickness of about ¼ inches or greater. The two sheave pulley 82 is part number 3099-T46 which is available from W. W. Granger, Inc., of Chicago, Ill. However, it is understood by those skilled in the art, that other materials are suitable for the beam 84 such as a wood, aluminum, plastic or the like, and the slider 86 can be made of steel or other suitable materials. Moreover, it is similarly understood that the shape and dimensions of the beam 84 and the slide 86 can be varied, if desired, to suit particular applications. Particularly, in applications where it is desirous to have the beam 84 mounted in the space created between two joists, the length of the beam 84 can be shortened, and angle brackets (not shown) can be used to attach the beam 84 to the sides of the joists 12.

Figure 8:
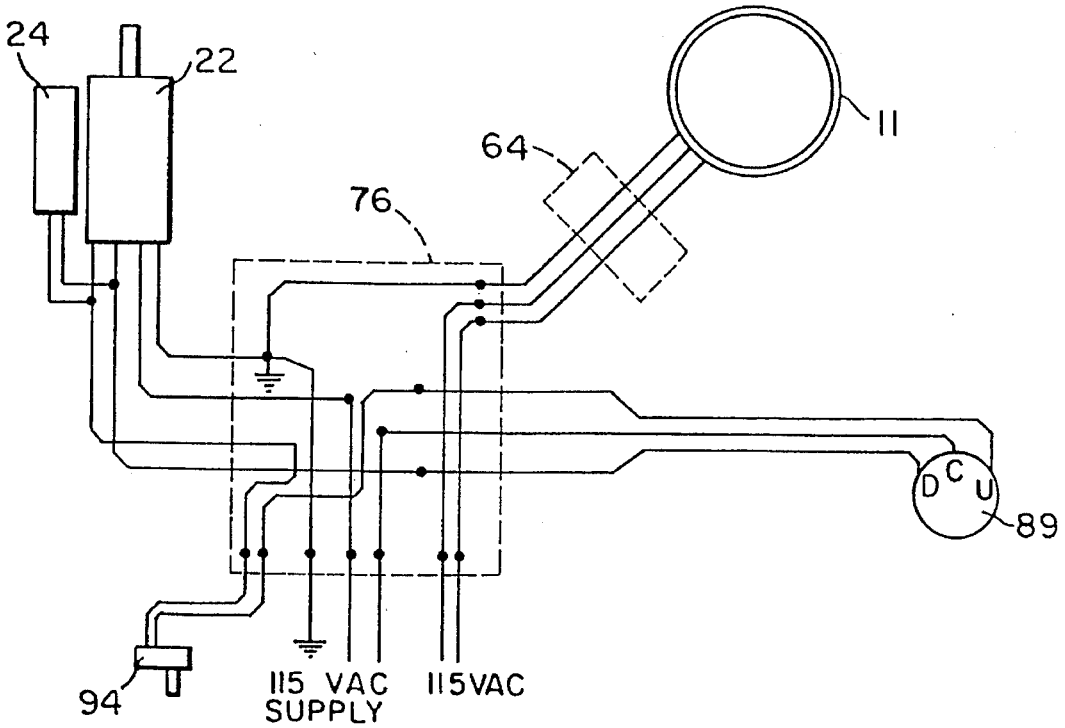
FIG. 8 is an electrical schematic circuit diagram for the motorized electrical apparatus of FIG. 1.

Referring now to FIG. 8, a control switch 89 is provided for activating the winch 30 to move the fixture 11 between the first and second positions. The switch 89 is a three position switch having a centered, off position (C), an up position (U) and a down position (D). In the preferred embodiment, the switch 89 is a key switch (not shown) and it can only be operated with a key. This prevents unwanted tampering from children, etc. Preferably, the three position key switch is part number HD3199360090152 which is available from Illinois Lock Co. of Wheeling, Ill. However, it is understood by those skilled in the art, that a variety of switches or even separate up and down switches can be utilized in accordance with the present invention, depending on the particular application.

Figure 3:
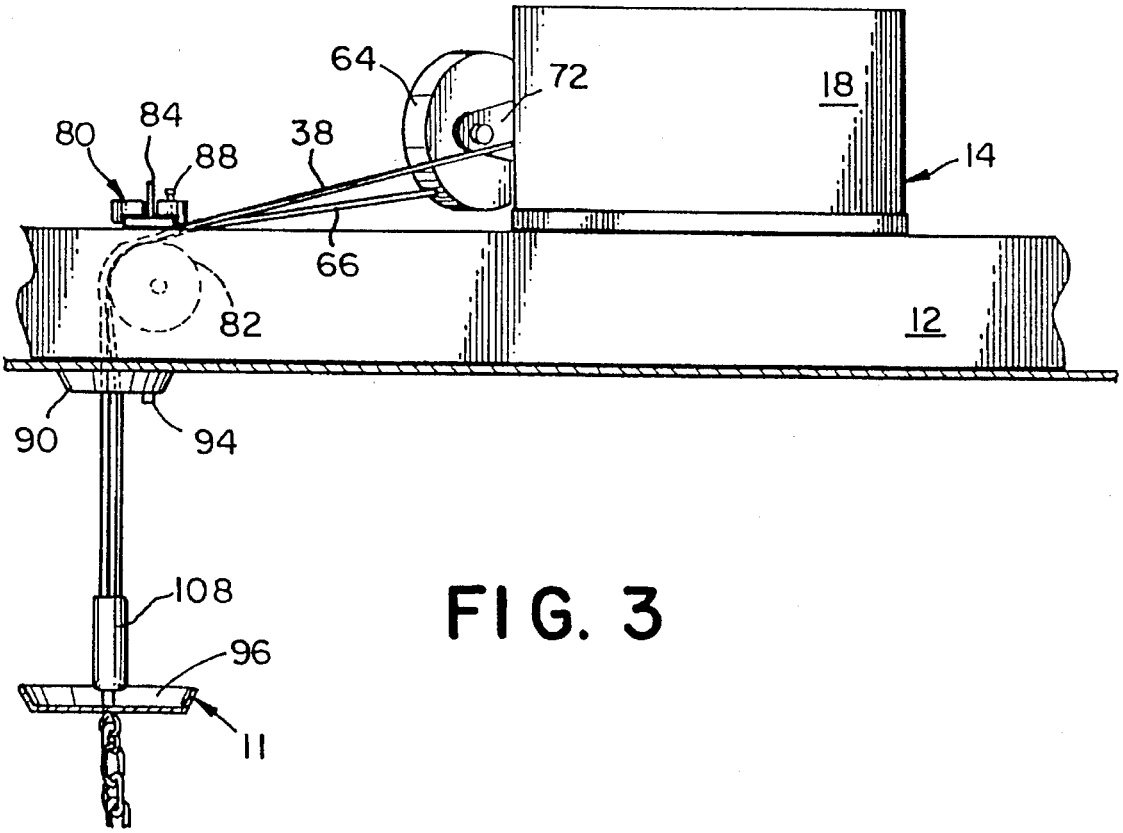
FIG. 3 is an elevational view of the motorized electrical apparatus taken along lines 3—3 of FIG. 2.

Referring now to FIGS. 3 and 6, a receiving ring 90 is mounted to the ceiling above the fixture 11 for guiding the winch cable 38 and the electrical cable 66 as the fixture 11 is moved between the first and second positions to ensure that the fixture 11 remains generally centered below its mounting position. The ceiling receiving ring 90 has a center aperture 92, which is aligned with apertures in the ceiling and the fixture junction box support beam 93 (shown in FIG. 1), through which the winch cable 38 and the electrical cable 66 pass. The aperture 92 has a tapered opening to prevent binding as the fixture 11 is drawn to its uppermost position. Preferably, the ceiling receiving ring 90 is $4\frac{13}{16}$ inches in diameter, which is less than the diameter of a standard fixture canopy 96, and the center aperture 92 is $\frac{11}{16}$ inches in diameter. The preferred thickness of the receiving ring 90 is ½ inch. However, it is understood by those skilled in the art that the shape and size of the receiving ring 90 can be varied.

A limit switch 94 for deactivating the winch assembly 30 from raising the fixture 11 after it reaches the first, uppermost position is provided. The limit switch 94 is installed in the receiving ring 90, and extends downwardly toward the canopy 96 of the fixture 11. The limit switch 94 is positioned on the receiving ring 90 such that the inside of the canopy 96 contacts the limit switch 94 when the fixture 11 is raised to the uppermost position. The limit switch 94 is preferably a contact switch which is deactivated when contacted. One such switch which is readily available is part number 7835K 12A from Eaton Corp. Other types of limit switches may also be employed.

Referring to FIG. 6, the connection of the first end of the electric cable 68 to the fixture wire 104 and the second end 39 of the winch cable 38 to the eye bolt 100 are shown in detail. The fixture wire 104 is threaded through the fixture chain 102 and the eye bolt 100 in the usual manner to a position above the canopy 96. Electrical connectors 106, such as wire nuts or crimped butt connectors, are used to connect the electric cable end 68 to the fixture wire 104. A loop is formed with the second end 39 of the winch cable 38 and connected through a loop in the eye bolt 100. An insulating sleeve 108 is installed over the winch cable 38 and the electric cable 66. The top of the sleeve 108 is tapered to permit easy entry of the sleeve 108 into the aperture 92 of the receiving ring 90. The insulating sleeve 108 can be moved upward along the two cables if access to the electrical connection is required. However, it is understood by those skilled in the art that electrical connections can be insulated by other means, such as a heat shrink cover.

Figure 7:
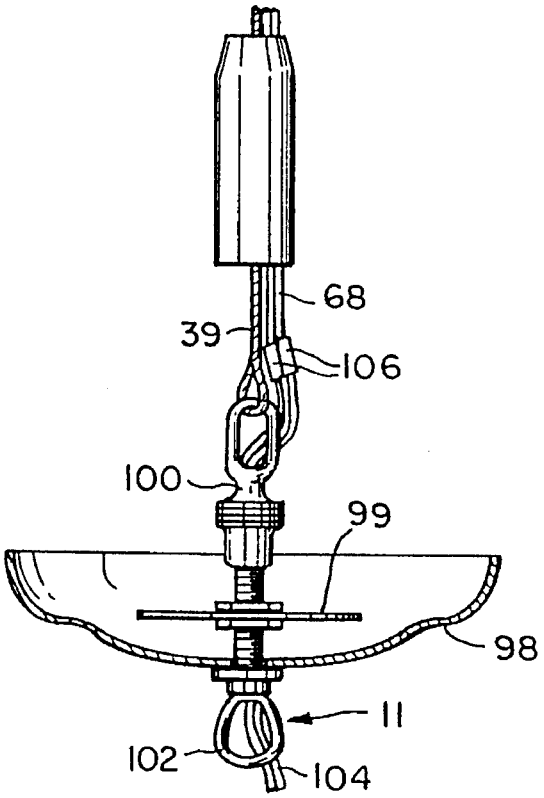
FIG. 7 is an enlarged view similar to FIG. 6 of an alternative fixture canopy arrangement.

Referring now to FIG. 7, an alternative embodiment of the present invention is provided. In the alternative embodiment, an oversized canopy 98 is attached to the top of the fixture 11. A stop member 99 is attached above the fixture 11 such that as the fixture 11 is raised to the first position, the stop member 99 contacts the limit switch 94 to deactivate the winch 30. The stop member 99 is mounted on an eye bolt 100 and adjusted to the proper height to contact the limit switch 94 when the fixture 11 is in the uppermost position. This arrangement is used with oversized canopies 98 which would not otherwise contact the limit switch when the fixture 11 is raised to the uppermost position.

The operation of the motorized electrical apparatus 10 for movement of an electrical fixture 11 with uninterrupted electricity follows with reference to FIGS. 1 and 8. When the switch 89 is moved to the down position, power is provided to the motor 22, which turns in a first direction. Drive gear 28 mounted on the motor shaft 26 drives chain 56 which turns gear 54 attached to the worm gear shaft 48. The worm gear 48, which engages the gear teeth 44 on the winch cable reel 32, turns the winch 30 unfeeling the winch cable 38. The weight of the fixture 11 acting on the unreeling winch cable 38 causes the fixture 11 to descend. As the winch cable 38 is unreeled, the fixture 11 is lowered from the first position to the second position and the electric cable 66 is unreeled from the retractable cable reel assembly 64 by the movement of the fixture 11. When the fixture 11 reaches the lower, desired service position, the switch 89 is deactivated by the operator turning the switch to the center, off position.

After the fixture 11 has been cleaned or serviced, the switch 89 is turned to the up position. Power is provided to the opposite poles of the motor 22, causing it to turn in the reverse direction, causing the winch reel 32 to reel in the winch cable 38. The spring loaded retractable cable reel assembly 64 rewinds the electric cable 66 as the fixture 11 moves upward. When the fixture 11 reaches its uppermost position, the inside of canopy 96 contacts the limit switch 94 deactivating power to the motor 22. Uninterrupted electricity can be provided to the fixture 11 through the electric cable 68 during the entire operation.

It will be appreciated by those skilled in the art that changes can be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A motorized electrical apparatus for movement of an electrical fixture with uninterrupted electricity provided to the fixture comprising:

a powered winch assembly for vertical movement of the fixture between a first, in-use position and a second, service position, the winch assembly including a moveable winch cable having a first end, which is anchored to the winch, and a second end, which engages the fixture;

a retractable cable reel assembly having an electric cable for providing electricity to the fixture, the electric cable having a first end, which is electrically connected to an electric power supply, and a second end, which is electrically connected to the fixture;

a pulley support assembly for mounting a pulley in a position above the fixture for guiding the winch cable and the electric cable as the fixture is moved between the first and second positions to maintain the fixture generally centered below the first position; and a control switch for activating the winch assembly to move the fixture between the first and second positions such that as the winch cable is unreeled, the fixture is lowered from the first position to the second position and the electric cable is unreeled from the retractable cable reel assembly by the movement of the fixture.

2. The apparatus of claim 1 wherein the winch assembly comprises a worm gear which drivingly meshes with gear teeth on a winch reel, the winch reel carrying the movable winch cable, such that the gear teeth on the winch reel cannot drive the worm gear in a reverse direction.

3. The apparatus of claim 1 wherein the cable reel assembly is pivotally mounted.

4. The apparatus of claim 1 wherein the winch assembly and the retractable cable reel assembly are mounted together as a unitary structure.

5. The apparatus of claim 4 wherein the height of the unitary structure is less than 9½ inches and the width is less than 14 inches such that the unitary structure can be mounted between ceiling joists.

6. The apparatus of claim 1 further comprising:

a limit switch for deactivating the winch assembly from raising the fixture after it reaches the first position; and a stop member attached above the fixture such that as the fixture is raised to the first position, the stop member contacts the limit switch to deactivate the winch.

7. The apparatus of claim 1 wherein the pulley support assembly is comprised of:

a beam which is mounted between two joists;

a sliding support moveable along the beam for supporting the pulley; and a locking device for locking the sliding support into a fixed position on the beam.

8. The apparatus of claim 1 further comprising:

a receiving ring mounted above the fixture for guiding the winch cable and the electric cable as the fixture is moved between the first and second positions to ensure that the fixture remains generally centered below its mounting position.

9. A motorized lifting apparatus for movement of an elevated light fixture with uninterrupted electricity provided to the light fixture comprising:

a powered winch assembly for vertical movement of the light fixture between a first, in-use position and a second, service position, the winch assembly including a moveable winch cable having a first end, which is anchored to the winch, and a second end, which engages the light fixture;

a retractable cable reel assembly having an electric cable for providing electricity to the light fixture, the electric cable having a first end, which is electrically connected to an electric power supply, and a second end, which is electrically connected to the light fixture;

a pulley support assembly for mounting a pulley in a position above the light fixture for guiding the winch cable and the electric cable as the light fixture is moved between the first and second positions to maintain the light fixture generally centered below the first position; and a control switch for activating the winch to move the light fixture between the first and second positions such that as the winch cable is unreeled, the light fixture is lowered from the first position to the second position and the electric cable is unreeled from the retractable cable reel assembly by the movement of the light fixture.

10. The apparatus of claim 9 wherein the winch assembly comprises a worm gear which drivingly meshes with gear teeth on a winch reel, the winch reel carrying the movable winch cable, such that the gear teeth on the winch reel cannot drive the worm gear in a reverse direction.

11. The apparatus of claim 9 wherein the cable reel assembly is pivotally mounted.

12. The apparatus of claim 9 wherein the winch assembly and the retractable cable reel assembly are mounted together as a unitary structure.

13. The apparatus of claim 12 wherein the height of the unitary structure is less than 11 inches and the width is less than 14 inches such that the unitary structure can be mounted between ceiling joists.

14. The apparatus of claim 9 further comprising:

a limit switch for deactivating the winch assembly from raising the light fixture after the light fixture reaches the first position; and a stop member attached to the winch cable above the light fixture such that as the light fixture is raised to the first position, the stop member contacts the limit switch to deactivate the winch.

15. The apparatus of claim 9 further comprising:

a receiving ring mounted above the fixture for guiding the winch cable and the electric cable as the fixture is moved between the first and second positions so that the fixture remains generally centered below its mounting position and for supporting the limit switch.

16. The apparatus of claim 9 wherein the pulley support assembly is comprised of:

a beam which is mounted between two joists;

a sliding support moveable along the beam for supporting the pulley; and a locking device for locking the sliding support into a fixed position on the beam.

* * * * *